US005951406A

United States Patent [19]

Steane

[11] Patent Number: 5,951,406

[45] Date of Patent: Sep. 14, 1999

[54] ADJUSTABLE SEE-SAW APPARATUS

[76] Inventor: Douglas A Steane, P.O. Box 1034, Elora, ON, Canada, N0B 1S0

[21] Appl. No.: 08/750,192

[22] PCT Filed: May 30, 1995

[86] PCT No.: PCT/CA95/00303

§ 371 Date: Nov. 27, 1996

§ 102(e) Date: Nov. 27, 1996

[87] PCT Pub. No.: WO95/32778

PCT Pub. Date: Dec. 7, 1995

[30] Foreign Application Priority Data

May 31, 1994 [GB] United Kingdom ..... 9410852

[51] Int. Cl.[6] ..... A63G 11/00

[52] U.S. Cl. ..... 472/111; 472/112; 434/194

[58] Field of Search ..... 472/106, 108, 472/111, 112; 434/194

[56] References Cited

U.S. PATENT DOCUMENTS

| | | | |
|---|---|---|---|
| 784,145 | 3/1905 | Donecker | 434/194 |
| 1,550,040 | 8/1925 | Nagy | 472/112 |
| 2,392,721 | 1/1946 | Burlin | 46/131 |
| 2,402,892 | 6/1946 | Hubble | 35/31 |
| 2,431,138 | 11/1947 | Ressinger | 472/112 |
| 2,551,668 | 5/1951 | Goosmann | 46/131 |
| 3,000,114 | 9/1961 | Orlov | 35/30 |
| 3,188,089 | 6/1965 | Odell | 273/131 |
| 3,212,202 | 10/1965 | Heinichen | 35/31 |
| 3,311,997 | 4/1967 | Denny | 35/31 |
| 3,339,291 | 9/1967 | Ruchlis | 35/19 |
| 3,486,244 | 12/1969 | Horn | 35/31 |
| 3,567,221 | 3/1971 | Stults | 273/1 |
| 3,613,268 | 10/1971 | Fowler | 35/31 R |
| 3,928,923 | 12/1975 | Harte | 35/31 R |
| 3,949,491 | 4/1976 | Harte | 35/31 R |
| 4,057,247 | 11/1977 | Morrison | 273/1 R |
| 4,218,835 | 8/1980 | Iseki | 35/31 R |
| 4,240,213 | 12/1980 | Lutin | 434/194 |
| 4,543,067 | 9/1985 | Wallen | 434/300 |
| 4,731,022 | 3/1988 | Garland | 434/194 |
| 4,871,314 | 10/1989 | Shih | 434/194 |

FOREIGN PATENT DOCUMENTS

| | | | |
|---|---|---|---|
| 255-058 | 2/1988 | European Pat. Off. | 472/112 |
| 1170569 | 3/1959 | France | 35/30 |
| 1237577 | 10/1959 | France | 434/194 |
| 2492137 | 4/1982 | France | 434/194 |
| 182793 | 3/1907 | Germany | 42/4 |
| 650205 | 2/1951 | United Kingdom | 132/146 |
| 240574 | 10/1987 | United Kingdom | 434/194 |

*Primary Examiner*—Kien T. Nguyen
*Attorney, Agent, or Firm*—Anthony Asquith & Co.

[57] ABSTRACT

The seesaw device is adjustable as to the lengths of the moment arms on the beam, of the two seats. Children can adjust the moment-arm length of their own seat in order to compensate for weight imbalances between them. A visible display scale informs of the child of the current moment arm setting.

17 Claims, 8 Drawing Sheets

ADJUSTABLE SEE-SAW APPARATUS

This invention relates to educational play equipment for children.

BACKGROUND TO THE INVENTION

The principle of the see-saw is well-known, in which two children sit at opposite ends of a beam, and the beam pivots for up/down movement about a fulcrum mounted on a support post. The invention combines the use of the basic see-saw idea with an adjustable mechanism to create a teaching/learning apparatus, in which children use their own physical bodies to help them acquire abstract concepts in mathematics and physics. Using their own bodies provides young children with a powerful bridge to fundamental abstract concepts in mathematics and physics, such as numerically-balanced equations, addition, leverage, and moment force.

BASIC FEATURES OF THE INVENTION

The invention makes use of a see-saw apparatus comprising the usual beam mounted for rocking motion on a pivot. The beam includes left and right arms extending in opposite directions away from the pivot.

The beam carries respective left and right seats, each of which is suitable for receiving a child thereon, and the apparatus is so arranged that the beam can undergo up/down pivoting movement, relative to the fulcrum point. The beam is so arranged as to define respective left and right moment arms for each seat; an operable adjustment means, when operated, is effective to allow the length of at least one of the moment arms to be adjusted.

THE INVENTION AS COMPARED WITH SOME PRIOR ART DEVICES

A well-known aid for teaching numerical relationships to children is the desk-top mathematical balance-bar apparatus, as found in many class-rooms. In this apparatus, a beam is provided with hooks, upon which weighted tags may be selectably hung. The hooks are placed at intervals along the length of the beam, whereby, for example, tags at positions 5 and 3 on one arm of the beam will balance tags (of equal weight) at positions 1, 3, and 4, on the other arm of the beam.

This mathematical balance is a well-known useful aid for teaching mathematical concepts such as addition and numerical equivalence. The apparatus of the invention is aimed at giving children direct physical experience of balance-force equivalence and numerical equivalence, which helps children acquire those concepts.

Young children of course learn concrete concepts more readily than abstract concepts. Similarly, children acquire abstract concepts more readily when the teaching environment creates opportunities for them to acquire the abstract concepts in concrete ways, for example through direct experience with gross-motor and sensory-motor activities. The learning of mathematical concepts, in particular (since those concepts are generally abstract) is made easier by providing the children with concrete experiences, using a wide variety of manipulatives. This is especially the case in the pre-school and primary school years.

Another prior art apparatus is a see-saw in which the see-saw device includes a means for sensing a weight imbalance between the two children using the device, and includes a counter-balance weight which automatically moves to equalize the moment arms of each side of the see-saw in response to the sensed imbalance. The contrast between this idea and the invention is very clear: in the invention, the aim is to enable the child to feel, physically, the effects of a weight imbalance, and to learn the manual skill of adjusting the beam accordingly, In relation to this prior device, it may be pointed out that a device which automatically compensates for differences in children's weights by-passes the child's chance of acquiring a perception of his own weight; indeed, making the device such that his own weight does not count in the moment arm equation may be regarded as an educational disservice to the child.

In the invention, the child is given the opportunity to make allowances for his own weight, and to learn how to adjust, numerically, for the magnitude of his own weight. When the adjustment is made automatically, the child learns nothing: or worse, he might even learn to stifle any perceptions he acquires of differences between his own weight and other children's.

Of course, the device of the invention, insofar as it is a see-saw, serves the usual play purpose of see-saws generally, in providing gross motor experience, and in providing for social and operational co-operation between the participants.

The type of teaching apparatus to which children give their best attention is the type which the children can act on and manipulate—not only with their hands but also with their whole bodies. Also, a teaching apparatus, if it is to be utilised attentively by children, should be such as to require the children to think at a level appropriate to their cognitive abilities. From these two standpoints, it is an aim of the adjustable see-saw invention to ensure a high level of mental attention by the children.

DETAILED DESCRIPTION OF PREFERRED EMBODIMENT

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
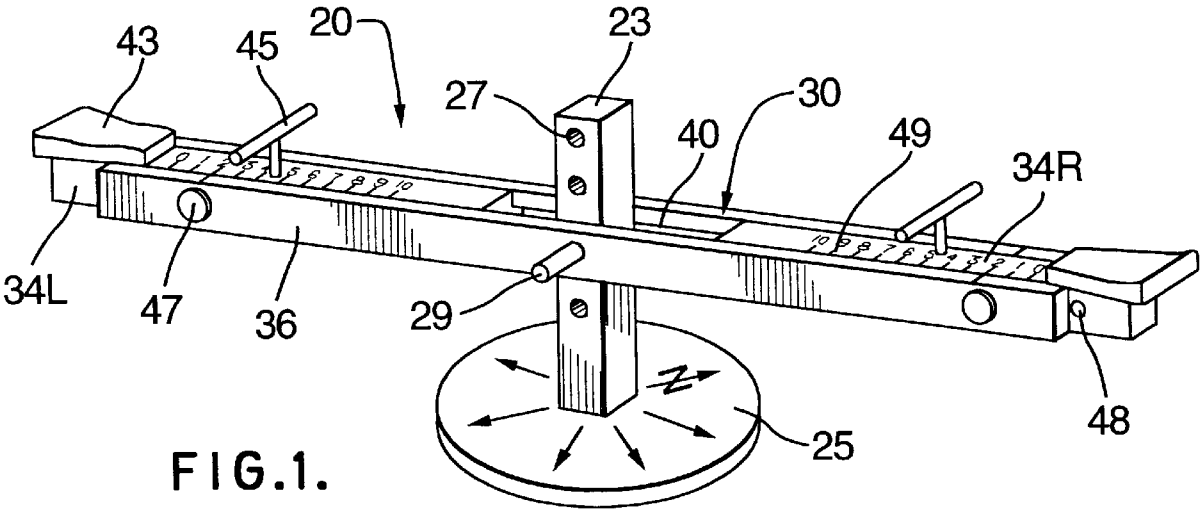
FIG. 1 is a pictorial view of a see-saw apparatus that embodies the invention.
Figure 2:
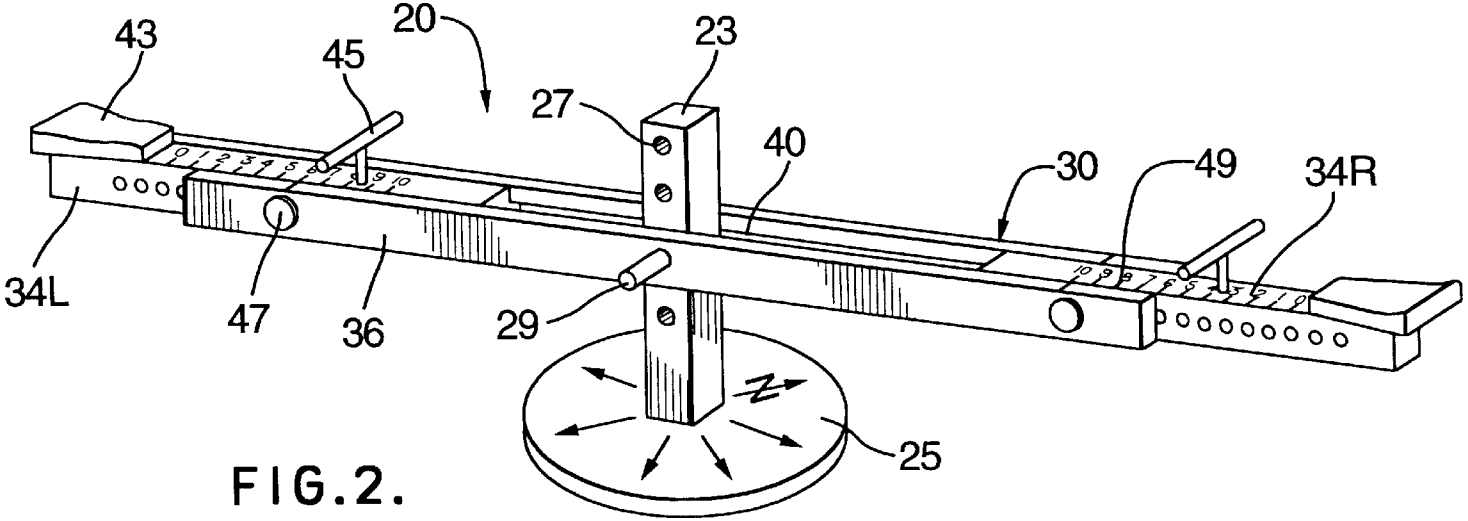
FIG. 2 is a corresponding view of the apparatus of FIG. 1, in which the apparatus has been adjusted to a different configuration.

The apparatus 20 shown in FIG. 1 includes a sturdy upright post 23, which is mounted fixedly on a base or plinth 25. The post 23 includes a series of through-holes 27, which are each adapted to receive a pivot pin 29.

The apparatus 20 also includes a beam 30. The beam 30 is of composite construction, and includes left and right end-pieces 34L,34R and a centre section 36. The centre section 36 is pivoted in the middle to the pivot pin 29.

The centre section 36 is in two pieces. These are provided on their inner, opposed surfaces with tongues 38. The end-pieces 34L,34R are formed with complementary grooves 40, which engage with the tongues. By virtue of the tongue-in-groove engagements, the end-pieces may slide longitudinally relative to the centre section 36, but are constrained against all other modes of movement relative to the centre section.

Each end-piece is provided with a respective saddle 43, and a handle 45 for holding on. These items remain fixed to the end-pieces during operation of the apparatus and during adjustment, although the items may be made detachable for dismantling/storage purposes.

Locking pins 47 are withdrawn whilst adjustment of the position of the end-piece relative to the centre section is being adjusted. Then, the locking pin is inserted and serves to lock the end-piece to the centre section. The end-sections are provided each with a number of lock-pin-holes 48, whereby the end-pieces 34L,34R may be locked at different extensions or locations relative to the centre section 36.

The lock-pin-holes 48 are numbered, as shown at 49, according to the number of units of distance each hole is from the fulcrum point defined by the pivot pin 29. The numerals 49 serve as a visible display scale, for indicating to the child what is the current setting of the moment arm of his seat.

The two end-sections 34L,34R need not be set each to the same lock-pin-hole 48 numeral, and in fact are set to different lock-pin-holes to cater for different sizes of children. The apparatus is symmetrical, however, whereby when both end-pieces are set to the same lock-pin-hole numeral, the beam 30 is nominally in balance.

Figure 3:
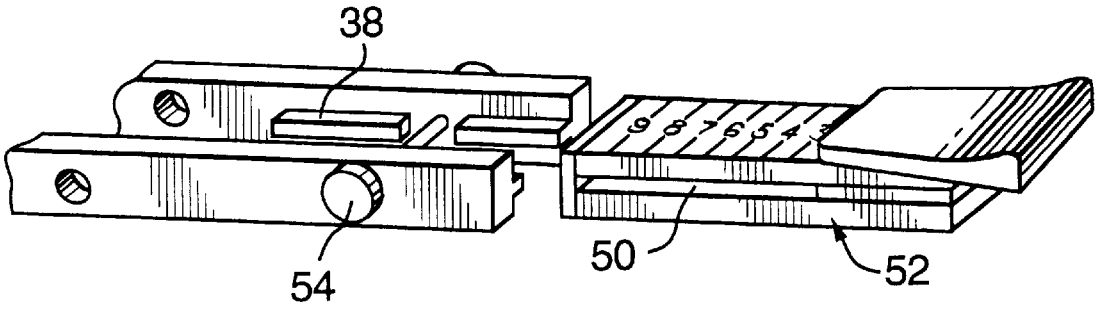
FIG. 3 is an exploded view of some of the components of another see-saw apparatus.

In the alternative shown in FIG. 3, lock-pin-holes are replaced by a through-slot 50 formed in the end-piece 52. The components are shown exploded in FIG. 3: in the operational device, in fact, the locking pin 54 normally resides in the slot 50. The pin 54 is threaded, and is of such a structure as to facilitate tightening by small hands. In order to develop problem-solving and other cognitive skills, children must be able to adjust the position of the end-pieces for themselves. Of course, young children will normally be supervised, and assisted as required. Children need to be initially taught how to use the apparatus.

Figure 4:
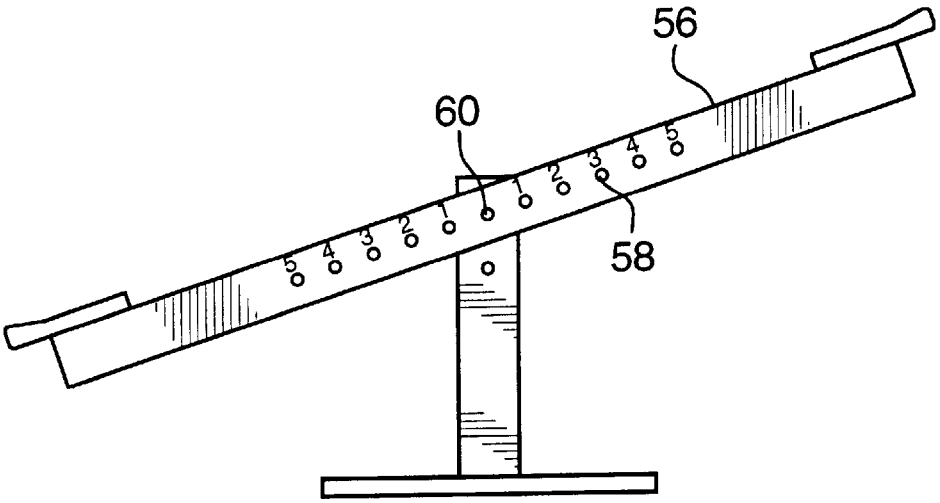
FIG. 4 is a side-elevation of another seesaw apparatus that embodies the invention.
Figure 5:
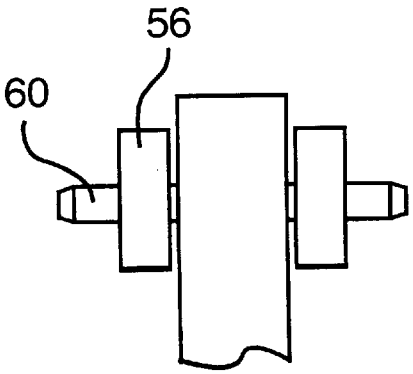
FIG. 5 is an end-elevation of the apparatus of FIG. 4.

The see-saw shown in FIGS. 4 and 5 is adjustable as regards the position of the fulcrum along the length of the see-saw beam. The beam 56 is provided with a series of pivot pin holes 58. The pivot pin 60 is inserted in a suitable one of the holes, to provide the required balance between children of different weights.

In the FIG. 1 device, the children can adjust both moment arms independently; whereas in the FIG. 4 device, only one end is adjusted, in effect; the other end is adjusted automatically in unison. Although the FIG. 4 design is simpler, whilst achieving basically the same result as the FIG. 1 design, the FIG. 1 telescoping design has a more engaging appeal for children, which significantly enhances the teaching-learning process.

Figure 6:
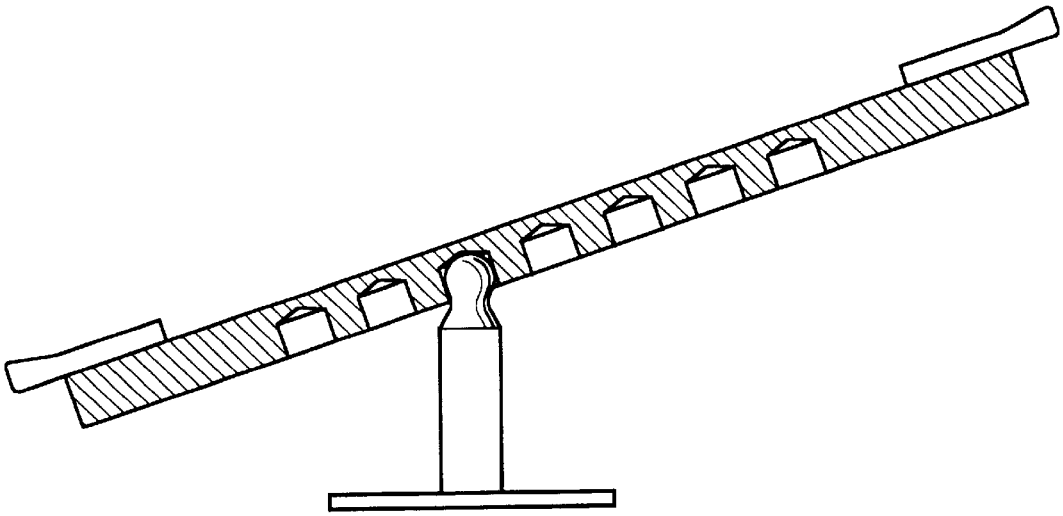
FIG. 6 is a cross-section of another apparatus that embodies the invention.

FIG. 6 shows a device that is like FIG. 4 in that adjustment is done by moving a single-component beam from socket to socket. The FIG. 6 beam can also rotate about the socket.

It is found that when using the devices as described, children come to appreciate mathematical relations more meaningfully. Children say such things as "when I am on 6, she has to be on 5 to balance me". These numbers help children acquire a concept of just what the physical difference is between different numbers. Children come to "feel" the effect of the differences.

Using the invention, it is expected that children will develop the ability to estimate other children's weights. This can occur with children even as young as age 4.

Many preschool children can count. But the counting is usually just rote-learned. Even if pre-school children can count out a number of objects (4 oranges, 5 apples, etc), learned as part of a counting sequence, the concepts learned in terms of object groupings usually do not come until later.

The visible scale should be marked in whole numbers, e.g from 1 to 10 for primary school children, and 1 to 5 for pre-school children. Although children may come to recognise numerical quantity or magnitude as a continuum more readily with the invention than previously, counting in discrete increments is preferred with young children.

Figure 7:
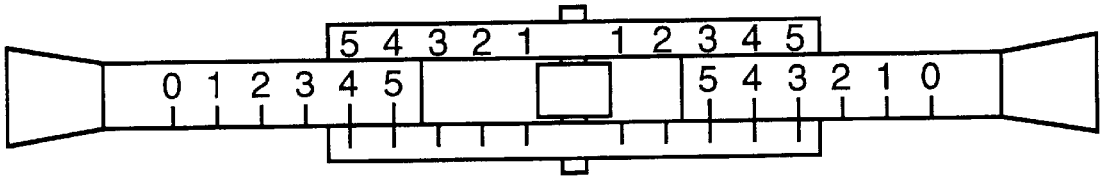
FIG. 7 is a diagrammatic view of a see-saw, showing an alternative for a numerical scale.

FIG. 1 shows that the numerals 49 may be marked along the lengths just of the end-pieces 34L,34R. Alternatively, as shown in FIG. 7, both the end pieces and the centre section may be provided with numerically-marked scales.

It will be understood that it may be necessary to explain to young children that they need to balance the beam of the see-saw to compensate for the difference in weight between them, and it may also be necessary to show them how to do this, ie how to adjust and use the device (in a safe manner). The device is not intended for self-instruction, although once children receive instruction that enables them to see how the device functions, they often learn to solve balance beam problems without adult supervision—even at 4 years old.

An aim of the invention is to provide an educational device whereby children can learn the concepts of balance, addition, multiplication, numerical equivalence, leverage, etc, and come to perceive the difference between weights on a see-saw, and learn to adjust them accordingly in order to balance the beam. In the process of using this equipment, the child comes to feel not just the effect of his own weight, but of his own weight in relation to the other children's weight.

Preferably, the device is designed for use indoors, where it is less likely that the adjustable components will become detached and lost, and where supervision is easier. Alternatively, the device may be adapted for use outdoors.

In FIG. 1, the base 25 is marked with the dial of a geographical-directional compass. When the apparatus is such that the beam can rotate, as well as teeter, the beam can be aligned with a particular direction. Teachers may initially need to teach children such opposing directions as North-South and East-West; but children usually learn for themselves to rotate and set the beam with reference to the dial after a period of repeated experience (with instructional input). Again, this quickness and ease of learning arises because the child is using his own body as a point of reference in relation to other points: the child actively aligns himself with other points, and looks along the particular direction.

The plinth might be provided with clock markings, alternatively.

Figure 8:
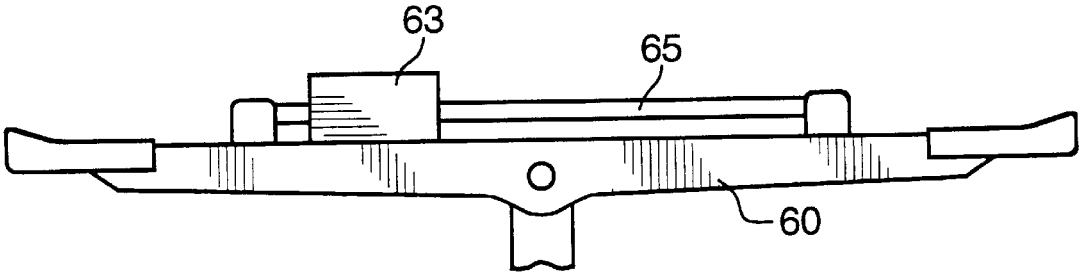
FIG. 8 is a side elevation of another apparatus that embodies the invention.

FIG. 8 shows another way in which the moment arm of the see-saw may be made adjustable. Here, the beam 60 and seats remain fixed, and the beam is provided with a weight 63, which is slidable on a suitable track 65. A numerical scale (not shown in FIG. 8) indicates to the children the current setting of the position of the sliding weight.

The various provisions for supporting the adjustable see-saw, and provisions for adjusting the moment-arm, as described above, may be integrated into a single structure. Here, a free-standing fulcrum supports a set of three related balance beams that function in three different ways, as follows:

1. a telescoping mechanism at each end of the adjustable balance is used to adjust the balance beam mounted in the centre of the structure;
2. a weight anchored to, and sliding along a track mechanism running the length of the balance is used to adjust the seesaw mounted at the left side of the entire apparatus;
3. a set of hook-on weights is used to adjust what amounts to a large mathematic balance, which is mounted at the right side of the apparatus.

The adjustable balance with the track mechanism (at the left side) that enables the weight to be readily shifted anywhere along the beam is the easiest balance to use with young children. They soon understand that if the children riding the see-saw are different in weight, sliding the weight along the track on the lighter child's side of the beam will help to bring the beam back into balance.

Once the children grasp the idea of balancing weight in a systematic manner, they can progress to the telescoping beam (in the centre) in which they learn that moving their own weight away from or towards the fulcrum systematically increases and decreases their influence (ie moment force) on the balance.

The telescoping and track adjustable balances provide opportunities for children to understand the relationships in mathematics and physics that teachers attempt to help children learn in school. When these see-saw systems are set up in playgrounds, parks, and school yards, children of all ages from preschool to early adolescence will explore and play with all three of the see-saws in any order. However, there will be a tendency for the younger children to play with the seesaw that is easiest to understand, and for the older children to play with the balance, which is the hardest to understand. In general, the telescoping see-saw is likely to receive the most attention, being the most popular feature of this system.

Figure 9:
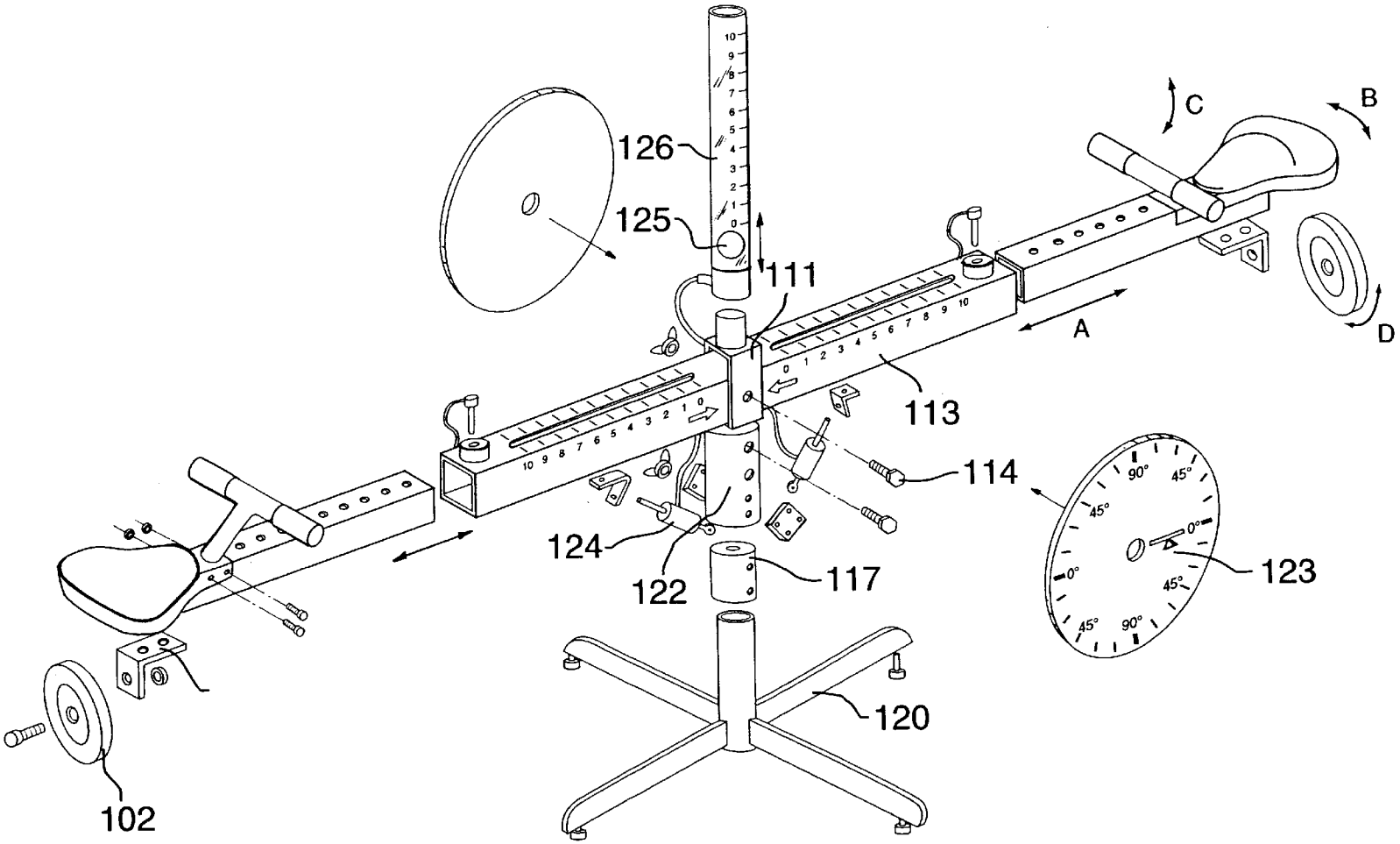
FIG. 9 is a pictorial view of another apparatus that embodies the invention.

FIG. 9 shows a structure of see-saw balance beam having features as described above.

The non-rotating plinth 120 carries a cap 117, which serves as a vertical-axis bearing for the rotatable sleeve 122. Trunnion plates 116 are bolted to the sleeve 122.

The two air pumps 124 are secured at their lower ends via pins to the trunnion plates 116. The piston rods of the air pumps 124 are secured by angle brackets underneath the centre section 113 of the cross-bar of the see-saw.

The centre-section 113 is mounted for up/down pivoting via the main horizontal-axis pivot-pin 114. The bracket 111, to which the section 113 is pivoted, is fixed to the rotatable sleeve 122.

Mounted on top of the bracket 111 is a hollow tube 126, made of clear plastic material. Inside the tube is a ping-pong ball 125. The ping-pong ball is such a fit inside the tube that the ball is free to move without touching, up and down inside the tube, and yet the fit of the ball is tight enough that air cannot easily flow through the gap between ball and tube. The fit is such that when air is pumped into the portion of the tube below the ball, enough pressure can build up that the ping-pong ball rises up the tube. On the other hand, when the pumping stops, air can leak around the ball, whereby the ball gradually sinks down the tube.

The space below the ball is connected via plastic pipes to the air pumps 124.

The top of the tube 126 includes a means for preventing the ping-pong ball being pumped right out of the tube.

Also fixed to the bracket 111 is a protractor 123, marked with a scale of angles, as shown. The section 113 is marked with arrows, whereby children may read off the angle through which the see-saw beam is being operated.

The section 113 may be of square aluminum tube. The saddle sections are complimentarily dimensioned, and arranged to telescope into the centre section 113.

As regards the numbers marked 1–10 on the centre section (FIG. 9) it is beneficial if the children can see the progression and sequence of the numbers in the scale, whereby the numbers, or the position of an indicator corresponding to the numbers, remains hidden until uncovered by movement of the scale. It is advantageous that during telescoping the child sees the inside end of the saddle section being uncovered, through the slot on top of the centre section. Alternatively, the numbers may be marked on the saddle section, whereby the numbers are uncovered and appear as the section is telescoped. Or, the designer may arrange the telescoping such that the centre section lies inside the saddle sections.

The saddle sections may be detached from the centre section, in which case the apparatus may be used more or less like a conventional balance bar, in which weights are hung from set points, to explore the lever/balance effect. It is better, from this standpoint, if the numbers are marked on the centre section rather than on the (detachable) saddle sections.

The wheels 102 secured underneath the saddles serve to cushion the blow if the see-saw should fall too quickly. Also, the wheels may serve as trundle wheels to measure round-the-circle distances when the seesaw is rotated about the vertical-axis bearing.

EDUCATIONAL VALUE IN COGNITIVE TERMS

As a specific multi-purpose, construction toy with a number of accessories and interchangeable parts, the adjustable power balance see-saw apparatus, which may be termed the science se-saw, is a manually-adjustable, see-saw-balance with a number scale on each arm of the ride-on beam. Through direct experience in riding and manipulating the apparatus, children receive a meaningful opportunity to acquire a host of fundamental concepts in mathematics and science primarily. To be specific, the science see-saw is an educational toy that has been designed and structured to facilitate the development of the following five different sets of cognitive concepts in mathematics, science and social studies to children in the pre-school and elementary school years:

I) MATHEMATICAL BALANCE CONCEPTS (1) Addition, Multiplication and Equivalence in Mathematics (2) Simple Algebra (3) Simple Linear Scaling (4) Balance (5) Weight and Mass (6) Leverage and Levers

II) WORK AND POWER (7) Cause and Effect Relations (8) Work and Power (9) Horizontal and Vertical Axes

III) BRIDGING TO CONCEPTS IN SOCIAL STUDIES

(10) From Mechanical Power to External Power and Control

(11) From Power of Balance to Balance of Power

(12) From the concepts of Power and Control in a dyadic experience to the concept of democracy

IV) ROTATION AND ORIENTATION IN SPACE

(13) Rotation

(14) Radius and Circumference of a Circle

(15) Geographical Directions

(16) Slope and Angle

(17) Level

V) LEARNING AND PROBLEM-SOLVING STRATEGIES

(18) The Scientific Method

(19) The Strategy of Systematic Manipulation

(20) Attention Span

(21) Analytic-Integrative Learning Styles

To elaborate in more detail, the preferred form of the science see-saw is a manually-operated toy that integrates an adjustable, mathematically scaled, ride-on beam mounted on a rotatable fulcrum, with a system of mechanical devices for harnessing the beam's motion and reflecting the performance of the children operating the apparatus. Simplistically, it may be viewed as an integration of three very popular devices—i.e., (1) seesaws, (2) mathematical balances, and (3) container balances for comparing mass and weight—used for two different purposes: (1) amusement and (2) education. As a see-saw, serving primarily an amusement function, the apparatus has been modified to make it educational. As a mathematical balance, or set of weight balances serving educational purposes, the apparatus has been developed to also make it enjoyable and physically involving for children. Thus, in considering an old idea from and educational perspective, using what was traditionally considered an amusement toy, it has been designed primarily for educational and child development purposes to stimulate problem-solving activities and teach fundamental concepts in mathematics and science.

STAGES IN THE CONSTRUCTION OF THE APPARATUS

A key feature of the apparatus is that weights imposed on the beam can be manually shifted away from or towards the fulcrum in the process of helping children achieve balance and learn about leverage. One of the most meaningful ways for children to accomplish this manoeuvre is to use a ride-on, telescoping-beam with seats that enables them to not only ride on the beam, but to also adjust their position in and out from the fulcrum by pushing the telescoping extensions in or pulling them out. Thus, although the mid-section of the beam is balanced and scaled in equal increments from 0 to 10 on each side of the fulcrum, there are telescopic extensions with seats for accommodating children that have been added to each end of the beam.

To the components of this structure, certain parts can be added or removed for related, multi-functional purposes. When the telescoping extensions of the beam are removed, the science see-saw functions as a mathematical balance or lever balance. From a developmental viewpoint, preschool children are ready to use the science see-saw with the extensions before being ready to use it without the extensions. The science see-saw gives younger or less developed children direct, concrete experience with concepts in mathematics and physics that are normally taught to older primary school children using conventional balances in a more abstract way.

When a mechanical system for harnessing the energy generated from the beam's motion is added to the apparatus, a third stage in the construction of the apparatus is created which addresses concepts on work and power.

The connecting mechanism between the base and the centre post of the apparatus enable the beam to rotate 360 degrees around the fulcrum like a carrousel. This rotational feature not only captivates the attention of young children, but creates an opportunity to acquire several concepts on rotation and orientation in space.

REFINEMENTS ON THE CONSTRUCTION OF THE BEAM

The beam portrayed in FIG. 9 consists of three sections: the main, middle section, balanced directly over the fulcrum, which includes a number scale from 0 to 10 on each arm, and two extensions that slide inside each arm of the mid section and can be locked into one of 10 positions along the scale of the main section with a dropin, gravity pin. Using this kind of telescoping mechanism, the adjustable nature of the beam is a key feature in the construction of the science see-saw.

Instead of making the telescoping extensions slide inside the middle section of the beam, there is an educational advantage, especially for preschoolers or under developed children, in making the extensions slide over the middle section of the beam so that the numbers on the scale of the main beam are covered when the extensions are pushed in and revealed when they are pulled out. For children who are just learning their primary number concepts and are just beginning to understand the systematic progression involved in the sequence of numbers from 0 to 5 or 0 to 10, a is mush easier for children to grasp the significance of this progression when they simultaneously observe how the length of an arm of the beam systematically increases as the sequence of numbers on the hidden scale systematically increase when the arm's extension is pulled out. For example, is the extension of an arm is pulled out one unit of length from 1 to 2 or from 2 to 3 and the child observes the beam increase in length a additional unit, then the child quickly learns that 3 is greater than 2 and 2 is greater than 1 and so on. However, these concepts are more difficult to learn when children, especially undeveloped children, are up against the challenge of learning these concepts in the midst of the whole scale in lieu of the most relevant part. Further more, this manipulative, hidden-scale feature has the extra advantage of creating a higher level of interest among young children who are still fascinated with the possibility that hidden phenomena still exist, even when they cannot be seen. Being put in the position of manipulating a device which alternately hides and reveals the existence of a hidden phenomena has the added effect of increasing the child's interest in both the phenomena and the device.

MATHEMATICAL BALANCE CONCEPTS

A key feature of the science see-saw is the way the beam has been developed and designed. The adjustable extensions enable children of unequal weight to make the adjustments needed to balance their weight on the apparatus in the process of riding it. As a result of these developments, the concepts of addition and equivalence, balance and leverage, are the first set of key concepts that can be taught to young children in the early primary years using this apparatus.

When the science see-saw is used strictly as a mathematical balance without the telescoping extensions, a number of mathematical operations can be learned. A weight placed on one side of a mathematical balance creates a moment about the fulcrum causing the arm to swing and then come to rest in an inclined position. To restore the arm to its horizontal position it is necessary to create an equal but opposite moment about the fulcrum. Because of the design of the mathematical balance, a weight placed on any scaled position along the beam appears to assume the numerical value of that position. Thus, if, for example, one weight is placed on the right-hand side of the arm on the position numbered 6, the resulting moment force may be balanced not only by placing one weight on position 6 on the left-hand side of the arm, but by placing one weight on position 5 and one weight on position 1, or in many other combinations.

The operation just described is written as follows:

$6\times1=5\times1+1\times1$ or simply:

$6=5+1$

To children, the mathematical balance is a means of setting up equations and checking their accuracy. It allows them to discover number relationships for themselves, although guided learning from the teacher is recommended. To take an example, if a child of six or seven is asked to find out how many ways the number ten may be balanced by two other numbers, then he/she is really finding the set of ordered pairs that satisfy the following equation:

$x+y=10$ $1+9=10$ $2+8=10$ $3+7=10$ $4+6=10$ $5+5=10$ $6+4=10$ $7+3=10$ $8+2=10$ $9+1=10$

At this early stage, teachers may be content to view this experience with the mathematical balance as simply a matter of finding the "number bonds" that equate to 10, but i the child's discoveries are organized in the form of a table, then other patterns become evident, including the commutative aspect of addition which is usually expressed as:

Examples for 10:

$a+b=b+a$ $1+9=9+1$ $2+8=8+2$ $3+7=7+3$ $4+6=6+4$

The child may solve, and the teacher may demonstrate, many mathematical examples of addition, subtraction, multiplication, division and equations using the mathematical balance incorporated into the science see-saw.

$_+4=6$ $\quad$ $15-_=6$ $4\times3=_$ $\quad$ $19-5=_$ $4_-2=10$

When the science see-saw is used strictly as a mathematical balance without the telescoping extensions, children may acquire the principles of balance and leverage as they learn how to balance weights on the arms of the beam. For example, if a weight is placed on the end of one arm, 10 equal increments out from the fulcrum, and two similar weights are placed half way down the other arm, 5 equal increments out from the fulcrum, then children learn that the weights not only balance, but also learn that a weight gains more strength and leverage on one side of the fulcrum in lifting a heavier set of weights on the opposite side as it is moved away from the fulcrum. However, when the telescoping extensions are added to the beam, enabling the apparatus to operate as a see-saw, offering children more direct physical involvement and experience, then these same concepts and principles become even easier to learn. In learning how to operate the science see-saw, children learn how to gain leverage or lose leverage by respectively moving away from or towards the fulcrum. A mathematical scale with the numbers inscribed or lettered along the beam gives children the opportunity to learn how the principles of balance and leverage can be precisely achieved using a mathematical measuring system in conjunction with the concept of addition.

In addition to the mathematical concepts of addition and equivalence, children learn to deal with the primary numbers of 0 to 5 or 0 to 10 in conjunction with a non-standardized, linear scale. Standardized scales may be introduced later as children learn about measurement in their mathematics curriculum. In general, children learn to understand how a scale functions in providing a scientific frame of reference for observing the effects of systematic change.

In addition to the physics of leverage and balance, children learn to deal with the concept of weight from a scientific perspective. Usually, weight is kept constant and leverage or moment force is varied in acquiring the principles of balance and leverage in using the apparatus. However, a greater understanding of the concept of weight can be achieved, if leverage or beam length is kept constant, while weight is varied in the use of this apparatus. Indeed, the science see-saw has been designed so that containers for receiving various weights can be attached or detached from the ends of the beam. In this way, such interchangeable parts, enable the science see-saw to function as a both a number (i.e., mathematical) balance and weight (i.e., container) balance.

WORK AND POWER

The science see-saw, also called the power balance, has incorporated other features to enhance its involvement and educational value for children. Mechanical hardware can be added to the apparatus for the dual purpose of harnessing the energy generating from the motion of the balance and for measuring the performance of the children in operating the apparatus. There are several ways to design such systems, including one for a manually-operated, water pump. However, a preferred version of the toy has attached a set of air pumps to the mid-section of the beam so that the up and down motion of the beam can be used to pump air into a vertical plexi-glass tube mounted over the fulcrum. Air pressure building up in the tube is used to raise an object such as a ping pong ball, for example. A scale running up the tube in equal increments from 0 to 10 enables the children to measure their performance. The ball rises in the tube to a lever according to the amount of air pressure created, which is contingent upon the amount of work that children put into pumping the beam. The effects which such mechanical accessories produce encourage greater involvement and interest on the part of the children in using the apparatus.

The feedback and performance features of the apparatus foster the development of another set of concepts that the balance is designed to address. Mechanical hardware, like the air pump assembly just described, creates the opportunity to enhance children's understanding of the concepts of work and power from the more visible and concrete, cause-effect relations that have been built into the apparatus. Children tend to get more readily involved with responsive toys that produce immediate and stimulating effects in response to their manipulations. Indeed, the science see-saw is designed to help children develop their notions of power stemming from the amount of work and resultant performance they experience on this apparatus.

Children learn that different amounts of work produce different levels of performance. They learn that the harder they work at levering the balance, the greater the results in terms of observable outcomes. On the other hand, conventional see-saws produce no observable effects other than their usual hypnotic-like sensations.

When the air-tube accessory is mounted on the apparatus, the science see-saw includes a set of three scales altogether: two horizontal scales—one on each arm of the main beam—and a vertical scale—positioned over the fulcrum at right angles to the horizontal beam. All three scales run from 0 to 5 for pre-school children or 0 to 10 for primary school children. In manipulating and adjusting the telescoping extensions and seats on the beam, children learn for example that two is greater than one and five is more than four as they watch the arms of the beam increase in length. In pumping the beam, children also learn that the harder they work, the higher the ball rises in the calibrated tube. However, although children gain greater leverage in moving their weight (i.e. moment force) away from the fulcrum, they lose power in their efforts to raise the ball in the air-tube because in the process of negotiating a longer stroke they cannot pump up and down as quickly as when they are positioned closer to the fulcrum. In this way, children operating the apparatus also learn more about the relationship between a scale running up a vertical plane and a scale running along a horizontal plane and about the factors in that relationship. In this respect, it should be noted that the erection of a scaled air-tube on the vertical axis of the apparatus creates an opportunity for children to learn about such geometric axes as the vertical axis and the horizontal axis as a prerequisite to the concept of geometric co-ordinates. Furthermore, for very young developing children in particular, who are working vigorously to raise the ball in the tube, the scale on the vertical tube furthers their grasp of the concept of "greater than" and the primary, cardinal number concepts.

BRIDGING TO BALANCE CONCEPTS IN SOCIAL STUDIES

With balance as the key concept, several math and science concepts emerge and develop out of the specific design and use of the science see-saw; yet, interestingly, the concept of balance, as addressed by the science see-saw, is also a bridging concept that goes well beyond the math and science concepts that have been discussed so far.

In considering the power of balance, there are specific principles that children discover in using the apparatus. Usually they discover that children who are well balanced on the beam can produce more mechanical power between them with less effort, while children who are not well balanced on the beam need to put more effort into producing the same amount of power. Furthermore, if one of the two children riding the beam has significantly more weight and leverage than the other, then that child gains greater control over the other child riding the apparatus and so a second kind of power emerges. On the other hand, when both children are well balanced, neither child is in control. Control becomes a shared experience. This second type of power, having to do with external power, should be distinguished from the first, having to do with internal power (a form of control inherent within the balance's mechanics), because it is more directly related to the broader, more abstract concept of balance of power that children learn about in social studies later.

The connections and the relations that can be drawn between the concrete representations of the apparatus and its abstract symbolic meanings (i.e., between children trying to achieve technical balance around a fulcrum versus people striving for a balance of power between organizations, communities, countries, etc.) are what make this apparatus a particularly meaningful tool. The mathematics and physics that can be taught about a beam resting or balanced over a fulcrum in primary school can lead to lessons and discussions in social studies on the concept of the balance of power later in elementary and secondary school. In addition, the issues of power and control that children experience on the apparatus on a dyadic basis provides an excellent opportunity to extend these issues into the political arena to aid in the development of the democratic concept.

ROTATION AND ORIENTATION IN SPACE

The final set of features incorporated into the design of the preferred version of the science see-saw foster the development of a third set of concepts in young children. Unlike movement in outer space, the laws of gravity on earth enable most children to turn around a full 360 degrees on a horizontal plane, but restrict their movement on a vertical plane (e.g., climbing walls). The fact that the beam will rotate around the fulcrum a full 360 degrees on a horizontal plane revolving around a vertical axis as well as move within safe limits on a vertical plane that partially revolves around a horizontal axis, creates the opportunity for young children to develop their concepts on rotation and orientation in space in a simplified, methodical way. With respect to this particular apparatus, these concepts include the concept of rotation, the geographical directions of north, south, east and west, and the concepts of slope, angle and level. The rotatable nature of the fulcrum, enabling children riding the science see-saw to spin around a fixed point, not unlike a carousel, creates an opportunity for children to experience the concept of rotation, which is basic to an understanding of how the earth spins, how a radar system works, or how the planets revolve around the sun, for example. As children revolve around a fixed point, opportunities to learn about the circumference of a circle emerge. The wheel mounted directly under the seat at each end of the beam not only cushions the fall as children come down on the balance, but also functions as a trundle wheel for measuring the circumference of a circle. As the length of the arms on the beam vary, children learn about the direct relation that exists between the radius and circumference of a circle.

The face of a geographic compass card, centred and placed over the base under the fulcrum and oriented appropriately within the context of the environment, creates opportunities for young children to develop their concept of north, south, east, and west within a stimulating and playful context and to learn to orient themselves in space accordingly. In the process of playing such directional games as spin-the-compass, children develop an awareness of how the beam, including their position on the beam, is oriented in space in geographical terms. They learn to track and understand how key reference points in space, in the context of their surroundings, relates to standard directions. This kind of systematic experience ultimately fosters the development of a better sense of direction in children, especially when travelling across territory (whether country or urban areas) that is unfamiliar.

In addition to learning about movement and direction on a horizontal plane, the science see-saw enhances the development of such concepts as slope, angle, and level, which has to do with orientation in space on a vertical plane. Features of the science see-saw that foster the development of these concepts and their degrees of deviation are (1) a pair of modified protractors on plexi-glass discs—mounted at the peak of the fulcrum around each side of the beam, scaled in increments of 15 degrees from 0 to 90—in conjunction with (2) indicator arrows on each arm of the main beam and (3) an adjustable fulcrum centre-post for changing the height of the beam along the vertical axis. Since the educational applications of this apparatus has been designed for use with elementary school children, the use of a protractor and compass is limited to the 90 degrees found in a quarter of a circle. However, different protractor plates from simple to complex can be used according to the level of development of the children using the apparatus.

As children move up and down on the see-saw, the slope and angle of the beam changes. line markers, arrows, and plumb lines on the apparatus can be used in conjunction with the protractor lines and markings to aid the process of measuring the slope and angle of the beam. Indicator arrows on the beam enable children to determine when the beam is level or horizontal with no slope.

In considering the full use of the science see-saw, it is important that teachers using this apparatus in the classroom and parents using it at home understand how the various physical features of this apparatus related to the three different sets of knowledge concepts in mathematics and physics that children explore and study in primary and elementary education. To summarize, first, the beam and its extensions foster the development of leverage and mathematical balance; second, the protractor and compass arrangements foster the development of rotation plus geometric and geographical orientations in space; third, the mechanical air-tube accessories foster the development of concepts like work and power. The concepts of work and power are related to the basic apparatus; the mechanical accessories further the development of these concepts.

INTERCHANGEABILITY OF PARTS

A feature of the science see-saw that has been briefly addressed at relevant points in the text is the versatile, interchangeable nature of certain components. It is this characteristic, resulting in different variations of the apparatus or conversely in the production of toy with a number of options and accessories, that helps make the apparatus so stimulating.

Of the various possibilities for exchanging parts, certain components offer a variety of different possibilities, while other components offer a variety of similar possibilities. With respect to the latter, the plexi-glass discs mounted on the fulcrum for lessons on slope and angle can be exchanged for a series of simple to complex protractors that are tailored to the child's level of development. Similarly, the compass plates mounted over the base of the apparatus for lessons on rotation and orientation in space can be exchanged for a series of compasses that increase in complexity according to the level of development of the child. For example, in helping children acquire such directional concepts as north, south, east and west, a simple directional plate could be later exchanged for increasingly complicated ones as children progress in their development.

With respect to the components offering a variety of different possibilities, it is helpful to review the "Stages in the Construction of the Apparatus" and "Work and Power" as distinct stages in the construction of the apparatus. The components that distinguish these stages from one another are (1) the telescoping extensions on the beam and (2) the mechanical hardware used to materialize the power which the pumping action on the beam produces. These components can be exchanged for very different parts. For example, in lieu of the extensions for riding the science see-saw, hand levers can be used to conduct experiments on leverage and levers. Similarly, in lieu of the air pump and tube system described earlier, a water pump for producing a variety of effects could be hooked up to the apparatus. In these ways, the interchangeable features of the apparatus significantly enhance its educational value. Furthermore, elementary school teachers today cannot afford to spend their budget on high-priced educational materials unless they address a multitude of fundamental concepts and functions in the math, science, and social studies curriculum.

Although the stage-construction feature is also a contributing factor, the interchangeable nature of the science see-saw's components leads to the production of optional accessory kits, among which teachers make choices depending upon their budgets and curriculum needs. To start, a basic science see-saw package may include a floor-size balance with numbered scales, the telescoping, extensions, seats and safety wheels. With this basic package, teachers can address most of the bridging and mathematical balance concepts as described. The rest of the concepts on work and power and rotation and orientation in space may be addressed using the following optional kits:

1. air pump and calibrated tube system for teaching concepts on work and power
2. water pump and fountain system as a work and power alternative
3. generator-light system as a third option for addressing work and power
4. series of directional compass cards for teaching specific concepts on orientations in space
5. series of exchangeable protractor plates for teaching level, slope and angle concepts
6. trundle wheel accessories with underlying mat of concentric circles and vectors for teaching concepts on rotation, radius and circumference of circle, and finally
7. hand lever extensions and container balance accessories for teaching concepts on leverage and levers and weight and mass respectively

LEARNING AND PROBLEM-SOLVING STRATEGIES

In addition to the knowledge concepts that the science see-saw fosters, there are a number of learning strategies and problem-solving concepts that it helps to develop. Among these is the scientific approach to learning how to systematically manipulate a variable to obtain discernible results. For example, through the systematic manipulation of a lever, children learn that, the greater the moment force on one side of the fulcrum, the easier it is to lift a weight on the other side. The fact that the science see-saw is designed to encourage the systematic manipulation of a number of variables like this leads to the development of the scientific approach to learning and problem-solving on a valuable generic basis.

The science see-saw has been designed like a construction toy. A system of wing-nuts and peg-in-hole connections make it easy for young children to make adjustments on the equipment or to take the apparatus apart and put it together with little or no help from older children or adults. This take-apart/put-together feature of the system creates lots of opportunity for action and manipulation. Toys which offer action and manipulation help maintain children's interest and focus and increase their attention span; but, the take-apart/put-together feature takes their cognitive development even further. Like puzzles, it fosters the development of their analytic-integrative strategies.

Of the many thinking processes and strategies that facilitate problem-soiving and learning, the ability to analyze and integrate information and ideas are among the most important. Whereas analysis is basically a functional thinking strategy for differentiating and isolating ideas or things into component parts, integration or synthesis is a strategy for combining and making perceptual and conceptual connections between things (parts) in the process of forming an organized whole. As two generic modes of problem-solving that work together in processing information, the analytic function defines the degree of focus while the integrative functions defines the degree of organization.

Child development research has shown that children not only vary significantly in their analytic-integrative abilities, with some children having better developed abilities than others, but that children with better developed analytic-integrative abilities solve problems much more effectively and learn concepts more readily than others. As a result, certain features have been incorporated into the design of the science see-saw to facilitate the development of such analytic-integrative processes. The fact that the science see-saw can be systematically broken down and built back up in three distinct stages, functioning somewhat differently at each stage at a different developmental level, helps children focus and organize their thinking abilities better. In a similar way, the adjustable and manipulative nature of the device stimulates the development of children's analytic-integrative abilities to the extent that such direct physical contact encourages children to focus their attention.

SOCIAL VALUE OF THE ADJUSTABLE BALANCE

The fact that two parties are required to operate any see-saw automatically demands their co-operation. In the case of conventional see-saws, a simple non-verbal agreement to work together is often all that is required. However, the adjustable science see-saw tends to encourage more social interaction and verbal communication, especially when it comes to making the various adjustments discussed earlier. For example, science seesaw adjustments often require social problem-solving in which children are encouraged to exchange ideas on what to do and then take turns experimenting with them.

PHYSICAL VALUE

Of the three major aspects of a child's development to consider, it would appear at first that the adjustable science see-saw would make its biggest contribution to physical development, particularly gross-motor as opposed to fine-motor development. In the case of conventional see-saws, this is certainly the case. However, having studied and reviewed the various features of the newly developed, educational balance, it now is easier to appreciate how a see-saw-like apparatus can have a much bigger impact on the social and cognitive development of young children then on their physical development.

SPATIAL REQUIREMENTS

The floor-size model of the science see-saw fits into any Kindergarten with ample space; but, it can take up more space than some primary classrooms can afford when the apparatus is fully extended. Fortunately, a number of factors can usually be exercised to readily solve this potential problem.

Measuring 7 feet (2 m) in length when fully extended, the apparatus will certainly fit into any classroom with enough space for circle activities. Although there were a number of reasons for doing so, the science see-saw was designed and developed as a construction toy in order to solve the spatial problems in small classrooms. In classrooms that are tight for space, it will need to be taken apart and put away, preferably on a cart organizer for easy and convenient storage and transportation. It should be emphasized, however, the science see-saw can be set up in a variety of settings in and around the school. It can be set up outdoors as well as indoors. The gymnasium area of a school is also a very appropriate place to put it. However, it is not a toy that can be left out in unsupervised play areas for any length of time. For such use, a modified version of the science see-saw would be preferred, which would retain the adjustable, but eliminate the exchangeable take-apart/put-together features.

MOTIVATIONAL ADVANTAGES

Mathematical and container balances have been around for a long time and are considered standard equipment in most schools. However, most young children do not take the initiate in using them until their classroom teacher initiates an activity involving their use. Even then, school children may not be intrinsically motivated to use these devices until their teacher finds a way of making their interactions with them interesting and meaningful. At any rate, more effort is usually required on the teacher's part to cognitively enhance the learning experience to ensure the children are doing more than simply going through the mechanics of the teacher's instructions.

One of the main advantages of the science seesaw over the mathematical balance is that children are intrinsically motivated to use it. Teachers do not need to put extra time and energy in to making their math and science lessons interesting. The child-oriented nature of the science see-saw already looks after that aspect of lesson planning and preparation. Indeed, in the words of one teacher who has used the apparatus in her classroom, "the science see-saw is an indispensable tool when you want to quickly capture the hearts and imaginations of young children."

The reasons the science see-saw captures and holds the attention of young children may be explored as follows. First of all, children can play with it. In fact, they recognize it as an amusement toy with which they can have fun. However, unlike conventional amusement devices, it is cognitively stimulating to use and so does a much better job of holding the attention of young children, In addition, the science see-saw is action-oriented: it turns, moves up and down, and is highly manipulative. This characteristic is important for the following reason: it is the action a toy offers that attracts the child. Indeed, the opportunities for action and manipulation are significantly more apparent with the science see-saw than they are with any of the bucket, number, pan, and lever balances.

The science see-saw may do a remarkable job of capturing the attention of young children, not to mention adults, but was never designed to eliminate the need for teaching. Children still need direction and guidance on how to use it, at least on a periodic basis, and teachers still need to deliver their lesson plans on the concepts the science see-saw addresses.

In sum, the adjustable science seesaw is an effective educational tool for not only teaching fundamental concepts in math, science, and social studies, and stimulating social and physical development, but is also a promising educational resource for stimulating language development and teaching children how to think.

A SCIENCE CENTRE

As pointed out above with regard to learning and problem-solving strategies, learning to use and apply the scientific method calls upon the ability to use several higher-order thinking skills. In addition to exercising their analytic-integrative abilities, children learn to observe, compare, suggest or predict, and test hypothesis, gather and classify data, interpret and evaluate results.

The real value and essence of science is not the knowledge it offers per se, but the methodology and process it involves for acquiring knowledge. Using the scientific approach to systematically manipulate and play with variables is a valuable way for young children to learn to think. The science see-saw has been designed and structured to facilitate the early development of this type of problem-solving strategy in young children. Specifically, the adjustable and numerically scaled features and characteristics of the science see-saw help to concretize the scientific experience for young children in a structurally well organized way. Using the scientific approach is normally an abstract process of manipulating an independent variable to observe how it affects some dependent variable. However, when the science see-saw is employed, children get directly involved in systematically manipulating the horizontal beam, which represents the independent variable, in order to directly observe how it affects results (e.g the height of the ball in the vertical air tube), which represent the dependent variable. Except for the contingency awareness events in which children love to participate at an early age, the science see-saw is about as close as young children will get to directly observing the experimental process visually unfold before their very eyes. Indeed, there are a number of interesting experiments which young children can learn to conduct using the science see-saw apparatus.

An understanding of the concrete relations between the science see-saw and the scientific method makes it increasingly clear that the science see-saw is not just an educational toy, but is actually a science centre that teaches a host of concepts and processes, and teachers will get more valuable use out of the apparatus, if they view it as such, planning programs around it that draw upon the ideas described.

CONCEPTUAL FRAMEWORK AND DEFINITIONS

See-saws and scientific balances (eg, pan balances, mathematical number balances, etc.) are popular materials found in a variety of outdoor and indoor environments that both entertain and educate. Whereas mathematical balances are limited to particular settings (e.g classrooms), see-saws—another type of balance—are found wherever children are found—in backyards, playgrounds, schoolyards, and recreation areas. Indeed, see-saws have been around for long time, well before they became popular piece of playground equipment. Perceived as primarily an amusement item, their educational value has been largely overlooked. However, the educational value of table-top balances are well recognized. By developing new structures that combine the see-saw with the balance, or the balance with the seesaw, well-established market needs are better met and new markets open up. This is because elements of the playful, which stimulate the emotions, are combined with elements of the educational which stimulate the mind. Historically in the development of material for children these two elements were usually separated—but more by accident than by design. Today, modern trends and philosophies of education recognize the importance of combining them to create more sophisticated educational products that not only make learning more fun, but are also designed to make it easier to learn.

Although both see-saws and balances are commonly found devices, children are often more interested in see-saws, at least initially. This is because children can directly experience their stronger sensory-motor effects. Consequently, designing balances to operate like see-saws significantly increases their emotional appeal to young children. On the other hand, incorporating educational and scientific features into see-saw designs significantly enhances their cognitive value. Children typically spend more time interacting and playing with materials that are both emotionally and cognitively appealing than they do with materials that only meet their emotional needs.

Since the kind of apparatus being developed here is a more engaging, child-oriented version of a conventional mathematical balance, it is important to have a clear understanding of just what a mathematical balance is. It is like a pan balance for teaching children about mass and weight with a beam mounted over a fulcrum pivoting point, except that, instead of suspending containers from the ends of the beam, number scales are inscribed along each arm of the beam with some means for attaching equivalent weights to the numbers. Teachers often use this type of balance to help primary school children acquire better understanding of the concepts of addition and multiplication, especially in relation to the concept of balance. They are not as common as pan balances but they are widely used in the elementary school system everywhere.

Mathematical balances are best distinguished from weight-container balances on the basis of how they enable children to manually manipulate the variable of (1) weight and (2) the positioning of weights along the beam in relation the fulcrum balancing point. Whereas with pan balances, weights are varied at fixed or constant distances from the fulcrum, in the case of number balances, weights remain constant, while their scaled distance in relation to the fulcrum varies. In using these variables to draw parallels between balances and see-saws, container balances may be more directly related to see-saws than number balances. By contrast, on the other hand a mathematical balance is distinguished from a see-saw/container balance primarily on the basis of its number scales, which permit the repositioning of weights along the beam.

The science see-saw was developed on the basis of principles in learning and science. The first principle, having to do with the learning process, is that effective learning occurs in the course of using hands-on, intrinsically motivating materials that offer young children lots of action and fun. The second principle has to do with the scientific method of systematically manipulating one factor, while keeping others constant. Since it is easier for young children to acquire concepts on cause-effect relations in the course of engaging in the hands-on practice of manipulating one factor while keeping others constant, the science see-saw was designed to facilitate the development of this fundamental scientific principle in young children. In the process of studying see-saws and balances it was realized that a limited number of variables and constants can be physically and nicely manipulated. Indeed, the basic variables of weights and position on the beam are the two factors common to all see-saws and balances that can be systematically varied. Consequently, the science see-saw was designed to encourage the manipulation of these two variables in systematic scientific fashion.

The following are features in the development of the science seesaw:

(1) a comparison of the similarities and differences of related materials, (2) the identification the development of child-orientated features that encourage children to interact with the materials, and (3) the development of scientific features that encourage and teach children in how to use the scientific method.

The first step in the above process is one that is universally applied to the creation of any innovation. The second step is one that is essential to the creations of any engaging high calibre toy. However, the third step is what gives the apparatus the specific science—oriented features resulting in its generic label.

The science seesaw leads to a well-developed, highly-engaging integration of mathematical balance with a see-saw-balance that enables children to systematically vary weights in fixed positions, vary positions with fixed weights, or vary both weights and positions simultaneously.

PLAYGROUND ADAPTATIONS

Figure 10:
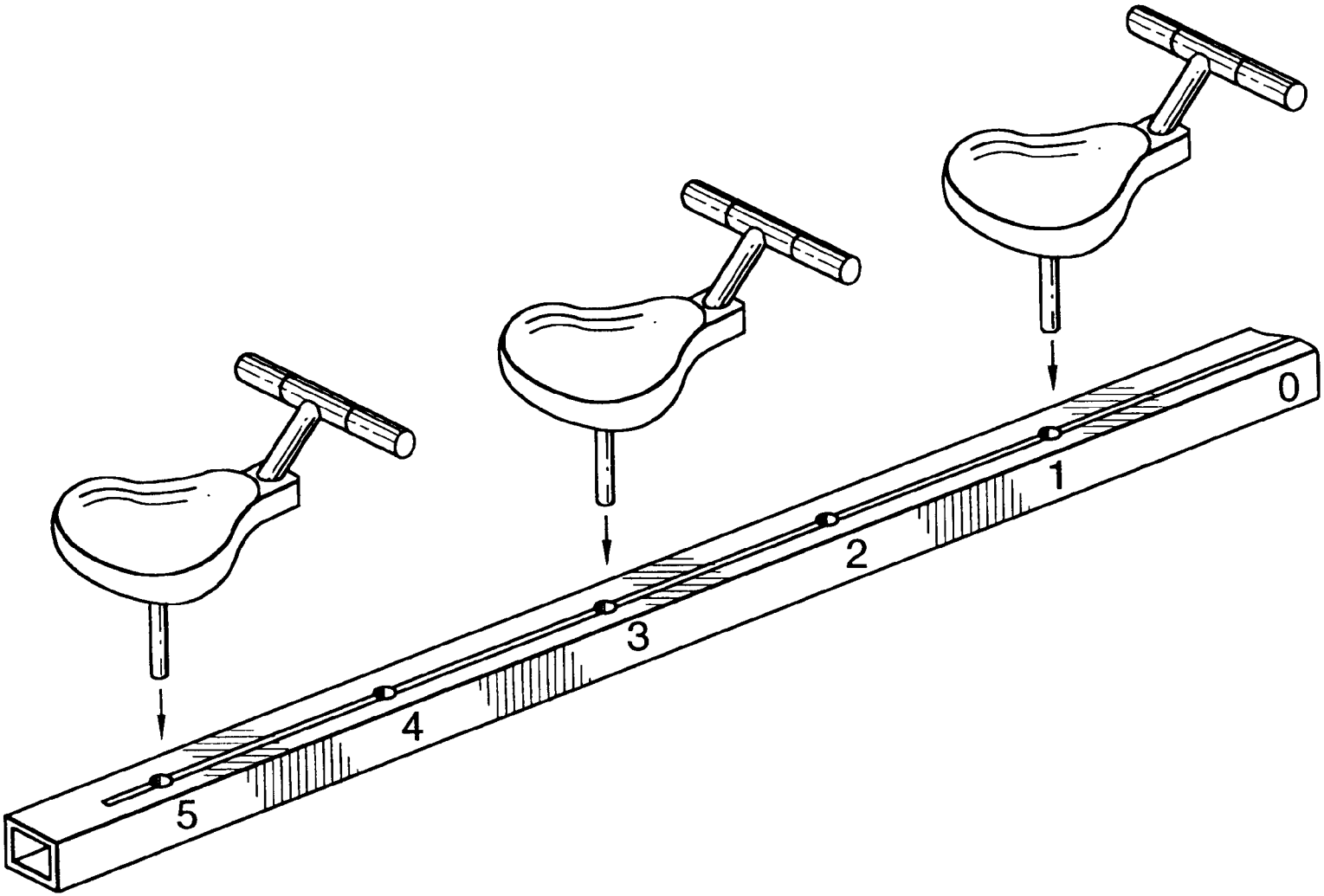
FIG. 10 is a cross-section of another apparatus that embodies the invention.

Although there is no reason why the science see-saw cannot be used outdoors under supervision, most playground equipment is designed and built to meet the high safety requirements of unsupervised public playgrounds. Consequently, in order to meet such requirements, the outdoor version (see FIG. 10) does not include the rotational and telescoping feature of the indoor, classroom version (see FIG. 9).

Given the constructive, interchangeable nature of the parts making up the science see-saw, the indoor version can be readily adapted to meet outdoor standards. The telescoping extensions can be removed from the beam and then 3 or 5 numbered seats can be added to each side of it to produce an outdoor version of the science see-saw that actually looks and behaves more like a mathematical balance. This version will not rotate, when locked-in or fixed, but the opportunities to produce stimulating effects and create action are well beyond the abilities of conventional see-saws.

Both the indoor and outdoor versions of the science see-saw employ the same fulcrum-frame and power assembly. And both versions employ a scaled number system along each arm of the main beam. However, the seating arrangements for the indoor apparatus is significantly different from the outdoor apparatus. Whereas the indoor version uses a single seat on each arm of the beam, the outdoor seesaw uses several seats on each arm. The single indoor seats are adjusted in relation to distance from the fulcrum with extended, telescoping arms. The multiple outdoor seats are locked in fixed positions along the scale of each arm.

Although the same fundamental concepts in math and physics are involved regardless of the seating arrangement and their method of adjustment, different thinking and learning processes are involved in both cases. The scaled telescoping beams teach and encourage children to be analytical and to use a structured, methodical approach to shift weight along the beam. On the other hand, the multiple seating arrangement of the outdoor apparatus does not aid in this same thinking process. They merely accommodate each child directly to a position on the scale. However, after children get the opportunity to exercise and develop their abilities in the classroom, as a result of using the science see-saw, their ability to transfer and generalize their learning to the less structured experience of the unsupervised playground increases.

Figure 11:
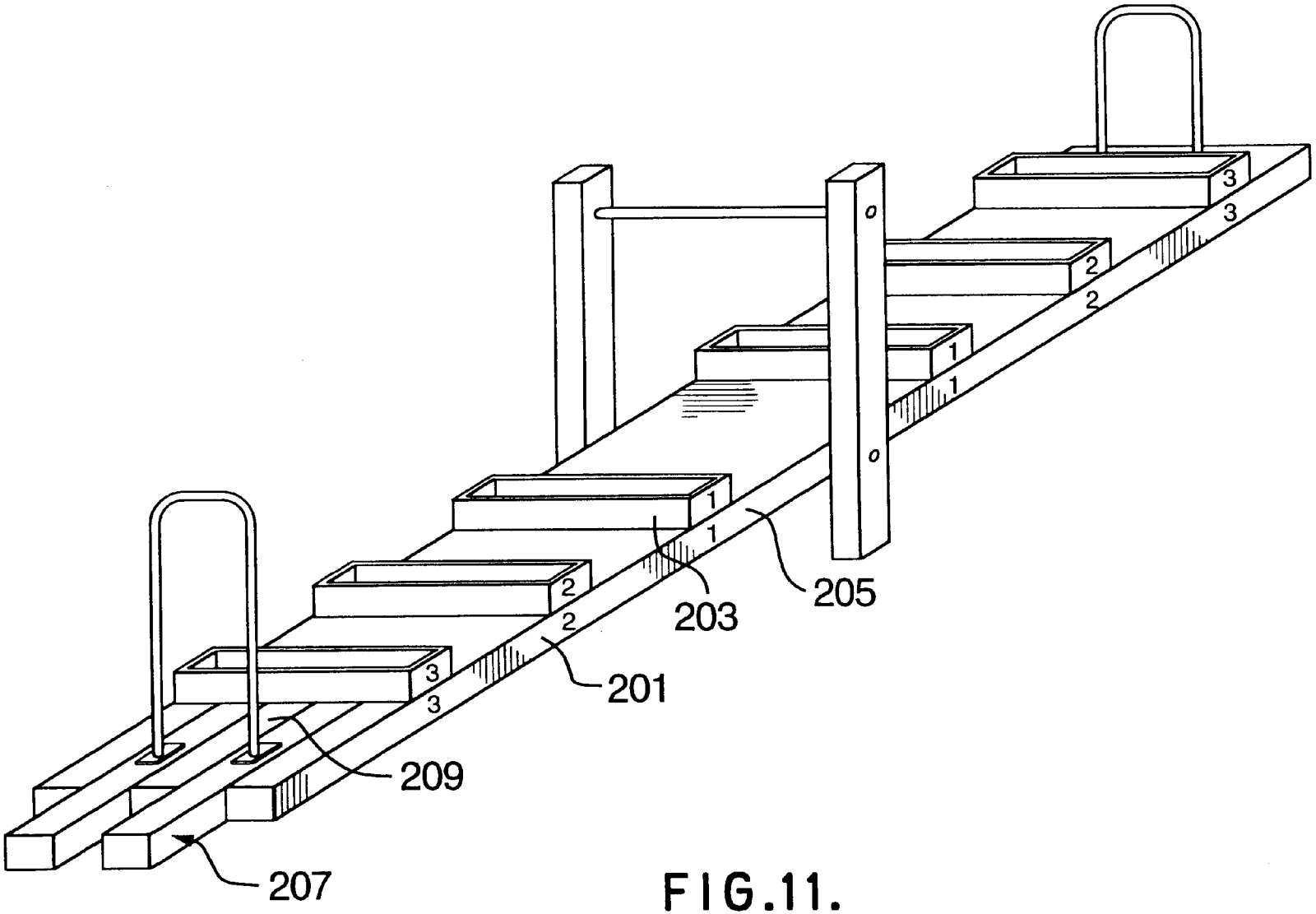
FIG. 11 is a pictorial view of another, platform-type, apparatus that embodies the invention.

In the platform see-saw illustrated in FIG. 11, children can employ a simple number scale 201, with a set of sand boxes or trays 203 superimposed over the scale, to enable the children to shovel sand into the boxes to adjust for differences in weight. In addition, since the platform 205 comprises beams strung together side by side, the inside beams 207 surrounding the centre beam 209 can be designed to adjust in a telescoping fashion. The hardware and a set of plans for this particular see-saw may be made available to enable parents and teachers to build it on a do-it-yourself basis.

FURTHER PLAYGROUND ADAPTATIONS

The same principles that were used to develop the scaled-down and scaled-up versions of the science see-saw could be applied to other types of see-saws. For example, the platform see-saw illustrated in FIG. 14 could be modified so that children can employ a simple number scale with a set of sand box trays superimposed over it to adjust for differences in weight and learn other concepts.

Figure 12:
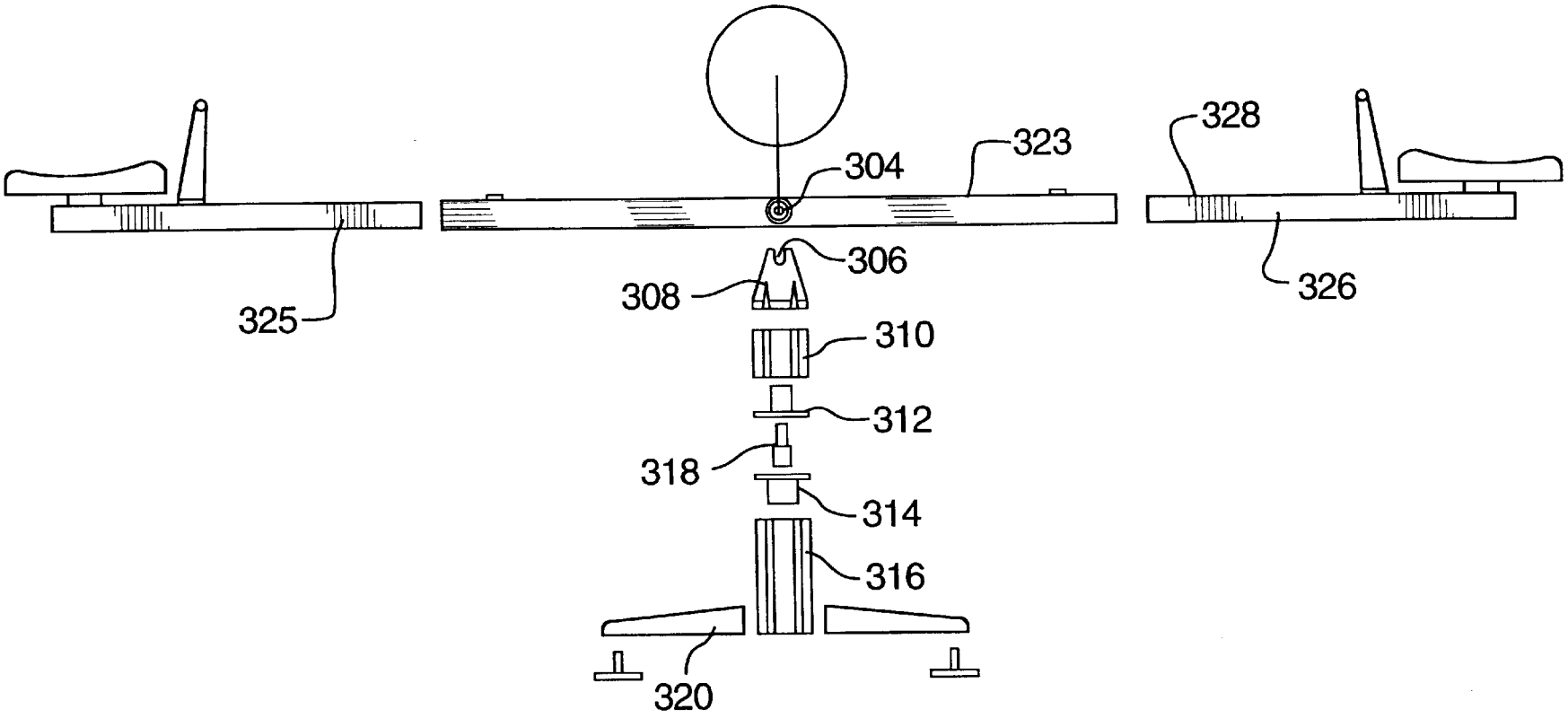
FIG. 12 is an exploded view of the components of another apparatus that embodies the invention.
Figure 13:
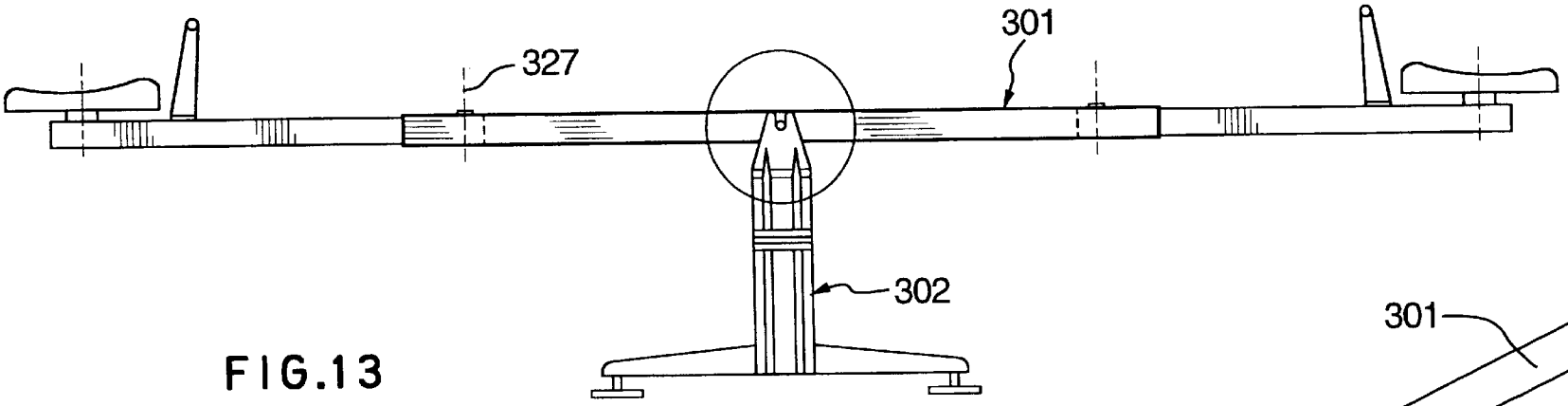
FIG. 13 is a side elevation of the apparatus of FIG. 12.
Figure 14:
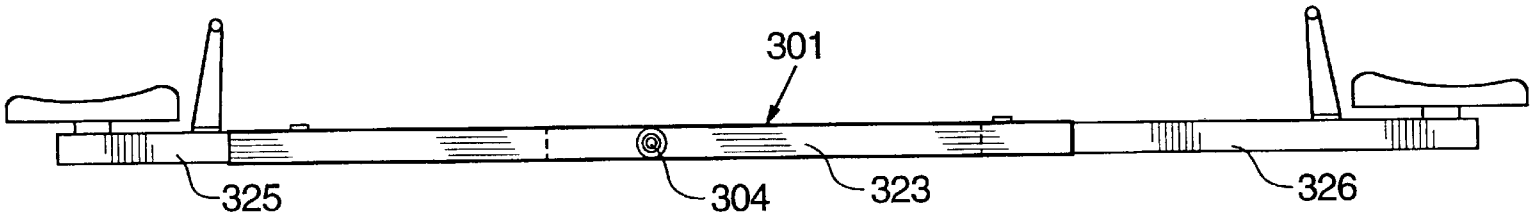
FIG. 14 is a side elevation of a component of the apparatus of FIG. 12, shown in a different condition.

FIGS. 12, 13, and 14 show a further preferred embodiment of the invention, in which the beam 301 of the see-saw simply rests on the pillar 302. FIG. 12 shows the components exploded, and FIG. 13 shows the assembly.

The beam 301 is provided, at its mid-point, with a fulcrum pin 304. The pin is engageable with slots 306 formed in the trunnion 308 on top of the pillar 302. The beam 301 can be removed from the pillar by simply lifting the beam.

The trunnion 308 is fixed to a component 310 of the pillar 302. A bearing 312, having a flange, fits into the hollow interior of the component 310. Also, a flanged bearing 314 fits into the hollow interior of the component 316 of the pillar 302. A bearing pin 318 is engageable with the two bearings 312,314.

By this arrangement, the components simply rest upon and in each other. Fasteners are not required. The pillar may be assembled and dismantled with little need for skill and application. Even so, the see-saw beam 310 is well-supported for rocking motion. The pillar 302 is fixed to (four) legs 320. Also, the beam may be rotated about the vertical axis of the bearing pin 318, for the reasons as previously described. As can be seen, these motions are safely constrained and guided by the structure as described, notwithstanding the simplicity of the structure.

The beam 301 includes a centre piece 323 to which the fulcrum pin 304 is fixed. The piece 323 is hollow, and receives the left and right extenders 325,326 of the beam.

The extenders may be telescoped into and out of the centre piece 323, and locked at a particular extension point by means of clips 327. FIG. 14 shows the beam 301 with the right extender 326 fully extended, while the left extender 325 is fully closed.

Numerals are marked on the respective top surfaces 328 of the extenders. Placed thus, the numerals disappear as the extenders 325,326 are telescroped into the centre piece 323. Young children find it quicker and surer to identify a point on a scale if the numerals are progressively covered and uncovered, compared with a pointer running along the scale. On the other hand, it is contemplated that the components may be arranged so as to make use of a pointer running along a scale to give the numerical indication of the magnitude of the extension.

Figure 15:
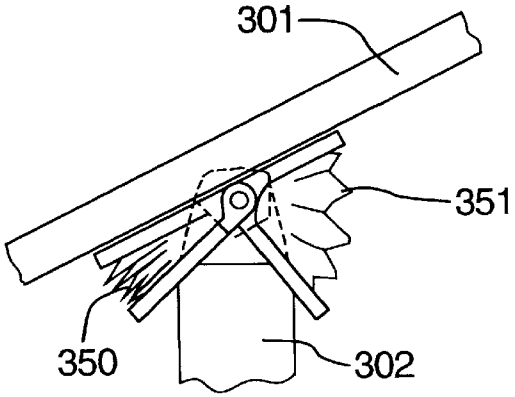
FIG. 15 is a close-up showing a component that may optionally be added to the apparatus of FIG. 12.

In the type of structure as shown in FIG. 12, air pumps may be provided, as was described in relation to FIG. 9, which act to pump a light-weight ball up an air-tube. In place of the left and right air-pumps, respective flap-type bellows may be palced in the left and right crooks between the beam and the pillar. FIG. 15 shows left and right bellows 350,351 adapted for securing underneath the beam 301, and rendered operable simply by engaging the beam onto the pillar 302.

The structures shown in the prior-published patents DE-2129594, U.S. Pat. No. 1,904,687, and U.S. Pat. No. 1,550,040 are outside the scope of the present invention, as claimed.

I claim:

1. See-saw apparatus, comprising a beam (30) pivoted at a fulcrum point to a support, wherein:

the beam carries respective left and right seats (43), each of which is suitable for receiving a child;

the apparatus is so arranged that the beam can undergo up/down pivoting movement, relative to the fulcrum point, and the beam is so arranged as to define respective left and right moment arms for each seat;

characterised in that the apparatus combines the above features with the following features:

the apparatus includes an operable adjustment means, which, when operated, is effective to allow the length of at least one of the moment arms to be adjusted;

and the apparatus includes a numerical scale and a visible scale display means (49), which is effective to display numerically the adjusted length of the moment arm.

2. Apparatus of claim 1, further characterised in that:

the numerical scale is arranged in whole number increments;

the visible scale display comprises written numerals, sequentially indicative of the said whole number increments;

the operable adjustment means includes separate left and right end-pieces of the beam, which are arranged for relative telescoping longitudinally along the beam;

the seats are fixedly mounted one each on the end-pieces;

and the apparatus includes means for locking the end-pieces at incremental locations, the increments of which correspond to numerals on the scale.

3. Apparatus of claim 1, further characterised in that the numerical scale is arranged in whole number increments.

4. Apparatus of claim 3, further characterised in that the visible scale display comprises written numerals, sequentially indicative of the said whole number increments.

5. Apparatus of claim 1, further characterised in that:

the operable adjustment means includes a beam comprising a center section and separate left and right end-pieces, which are arranged for telescoping longitudinally along the beam, relative to the center section;

and the seats are fixedly mounted one each on the end-pieces.

6. Apparatus of claim 5, further characterised in that the apparatus includes means for locking the end-pieces at incremental locations, the increments of which correspond to numerals on the scale.

7. Apparatus of claim 5, further characterised in that the centre section is hollow, and the end-pieces are arranged to telescope inside the center section.

8. Apparatus of claim 1, further characterised in that the beam is pivoted at the fulcrum point on the support in such a manner that the beam can rotate about a vertical axis at the pivot point.

9. Apparatus of claim 8, further characterised in that the support comprises a post mounted on a plinth, and the plinth is marked with markings depicting directional indicia.

10. Apparatus of claim 8, further characterised in that the apparatus includes a pillar having two separate components, which are relatively rotatable about a vertical axis.

11. Apparatus of claim 10, further characterised in that:

the pillar includes a guide means for receiving the beam, and for guiding the beam for pivoting movement about a horizontal see-saw axis relative to the pillar;

the guide means is so arranged that the guide means is effective to guide the beam for the said movement upon being simply placed in, and then resting under gravity in, the guide means.

12. Apparatus of claim 10, further characterised in that:

the operable adjustment means includes a series of couplings formed in the beam, each coupling being independently assemblable to the pillar, and each coupling being so formed that, upon the coupling being assembled to the pillar, the coupling is effective to guide the beam for see-saw pivoting movement with respect to the pillar;

and the couplings are spaced apart longitudinally along the beam.

13. Apparatus of claim 1, further characterised in that the operable adjustment means comprises a sliding weight and a guide, and the guide is effective to guide the weight for sliding longitudinally along the length of the beam.

14. Apparatus of claim 1, further characterised in that the apparatus includes a fluid pump, and a means for mounting the fluid pump on the apparatus in such a manner that the pump receives mechanical energy from the beam when the beam is undergoing see-sawing movement, and the pump is effective to convert said mechanical energy into pump energy output, and the apparatus includes an indicator, for visibly indicating the said pump output.

15. Apparatus of claim 14, further characterised in that the indicator comprises a ball rising in vertical tube.

16. Apparatus of claim 1, further characterised in that the apparatus includes a protractor, carrying suitably marked indicia, which is so arranged in the apparatus that the indicia indicate the angle through which the beam pivots about the see-saw fulcrum.

17. Apparatus of claim 1, further characterised in that the apparatus includes wheels placed underneath the seats.

* * * * *